US008025089B2

(12) United States Patent
Chelednik et al.

(10) Patent No.: US 8,025,089 B2
(45) Date of Patent: Sep. 27, 2011

(54) MECHANISM FOR UNTANGLING WINDOW CORDS

(75) Inventors: George Chelednik, Bethel, CT (US); Joe Zakowski, New Cannan, CT (US); Amnouy Athitang, Bridgeport, CT (US)

(73) Assignee: Rollease, Inc., Stamford, CT (US)

( * ) Notice: Subject to any disclaimer, the term of this patent is extended or adjusted under 35 U.S.C. 154(b) by 1053 days.

(21) Appl. No.: 11/355,503

(22) Filed: Feb. 16, 2006

(65) Prior Publication Data

US 2007/0187049 A1 Aug. 16, 2007

(51) Int. Cl.
*E06B 9/30* (2006.01)

(52) U.S. Cl. ..... 160/170; 160/171; 160/84.01; 160/84.04

(58) Field of Classification Search ..... 160/170, 160/171, 84.01, 84.04
See application file for complete search history.

(56) References Cited

U.S. PATENT DOCUMENTS

| | | | | |
|---|---|---|---|---|
| 2,579,144 | A | | 12/1951 | Griesser |
| 2,732,010 | A | | 1/1956 | Griesser |
| 4,372,432 | A | | 2/1983 | Waine et al. |
| 4,433,765 | A | | 2/1984 | Rude et al. |
| 4,492,261 | A | | 1/1985 | Chong |
| 4,499,937 | A | | 2/1985 | Waine et al. |
| 4,623,012 | A | | 11/1986 | Rude et al. |
| 4,697,630 | A | | 10/1987 | Rude |
| 4,729,418 | A | | 3/1988 | Rude |
| 5,058,720 | A | | 10/1991 | Rude et al. |
| 5,103,888 | A | | 4/1992 | Nakamura |
| 5,228,491 | A | | 7/1993 | Rude et al. |
| 5,328,113 | A | * | 7/1994 | de Chevron Villette et al. ..... 242/388 |
| 5,375,643 | A | | 12/1994 | Rude |
| 5,482,105 | A | | 1/1996 | Rude |
| 5,507,374 | A | | 4/1996 | Rude |
| 5,566,741 | A | | 10/1996 | Ogawara |
| 5,725,040 | A | | 3/1998 | Domel |
| 5,791,390 | A | | 8/1998 | Watanabe |
| 5,791,393 | A | | 8/1998 | Judkins |
| 5,908,062 | A | * | 6/1999 | Fun ..... 160/170 |
| 6,032,716 | A | | 3/2000 | Mattey |
| 6,129,131 | A | | 10/2000 | Colson |
| 6,202,967 | B1 | | 3/2001 | Fraczek |
| 6,223,802 | B1 | | 5/2001 | Colson |
| 6,237,667 | B1 | | 5/2001 | Fraczek |
| 6,244,532 | B1 | * | 6/2001 | Watanabe ..... 242/399.1 |
| 6,685,592 | B2 | | 2/2004 | Fraczek et al. |
| 6,792,999 | B2 | | 9/2004 | Cross et al. |
| 6,817,402 | B1 | | 11/2004 | Fraczek et al. |

(Continued)

FOREIGN PATENT DOCUMENTS

| | | |
|---|---|---|
| DE | 15 09 779 A1 | 7/1970 |
| EP | 0 918 133 | 11/1998 |

*Primary Examiner* — Katherine Mitchell
*Assistant Examiner* — Candace L Bradford
(74) *Attorney, Agent, or Firm* — Gottlieb, Rackman & Reisman P.C.

(57) ABSTRACT

A lifting system for a window covering has a movable shaft disposed within a cradle that is held within a head rail. The movable shaft has an end portion and a lift cord wrapping portion. A lift cord is connected to the movable shaft. A transition member is disposed between the end portion and the lift cord wrapping portion. The transition member acts as a ramp to facilitate migration of the lift cord to the lift cord wrapping portion once bird nesting has occurred.

27 Claims, 9 Drawing Sheets

U.S. PATENT DOCUMENTS 6,854,503 B2 2/2005 Cross et al.
6,935,401 B2 8/2005 Fraczek et al.
6,981,539 B2 1/2006 Fraczek
7,178,577 B2 * 2/2007 Liu ..... 160/170
7,210,646 B2 * 5/2007 Hsu ..... 242/397
2003/0178155 A1 9/2003 Fraczek

* cited by examiner

MECHANISM FOR UNTANGLING WINDOW CORDS

FIELD OF THE INVENTION

This invention relates generally to window treatments or coverings, such as blinds or shades, and specifically to a mechanism for untangling lift cords used to raise or lower such coverings.

BACKGROUND OF THE INVENTION

Present day lifting or lowering systems for blinds or shades utilize one or more lift cords in order to raise or lower the blind or shade. The lift cord usually wraps around a movable shaft, which is driven by a drive shaft. Ideally, the lift cord should be wound around the movable shaft in a single layer, preferably with the lift cord wound with adjacent abutting loops, allowing the lift cord to raise or lower the blind or shade without any difficulty.

Mechanisms have been devised which attempt to have the lift cord wrap around the movable shaft in a single layer in an adjacent fashion. For example, U.S. Pat. No. 5,328,113 to de Chevron Villette discloses a drum which is attached to the lift cord. The lift cord initially is wrapped around a cylindrical or conical drum of greater diameter. As the cord advances along the cylindrical or conical drum, the cord eventually falls off this drum portion with limited tension, thereby enabling the cord to wrap around the lift cord drum in a single layer.

Other mechanisms which attempt to have the lift cord wrap around the movable shaft in a single layer are exemplified by the patent to Domel, U.S. Pat. No. 5,725,040, and the patent to Colson, U.S. Pat. No. 6,223,802. Domel discloses a relatively long spindle channel and spindle, with the distance between the two approximating the diameter of the suspension cord. Colson discloses an outer cylindrical shell distanced away from the spring spool by a distance slightly greater than the diameter of the lift cord and extending the entire length of the shaft.

Despite efforts to have the lift cord wrap around the winding drum or shaft in a single layer, tangling of the lift cord often results when only one end of the blind or shade is lifted, or if one end of the blind or shade hits an obstruction as the blind or shade is raised or lowered. The lift cord thus becomes tangled along the movable shaft onto which the cord normally is wrapped. This tangling, often called "bird nesting," is particularly troublesome if the lift cord becomes tangled over the drive shaft. Once bird-nesting occurs over the drive shaft, it is often difficult to restore the cord back onto its desired position on the movable shaft.

Neither the mechanisms disclosed in the Domel or the Carlson patents remedy this situation. In fact, because the lift cord is constrained within a small space only slightly greater than the diameter of the lift cord itself, the cord can easily jam within this space thereby making proper operation problematic.

SUMMARY OF THE INVENTION

Accordingly, one aspect of the present invention is to provide a lift system which overcomes the problems of the prior art.

Another aspect of the present invention to provide an improved lift system for a blind or shade, which enables the lift system to work properly after bird-nesting has occurred.

A still further aspect of the present invention is to provide a lift system for a blind or shade in which the lift cord is allowed to migrate from the drive shaft back to the movable shaft of the lift system even if bird-nesting occurs.

Yet another aspect of the invention is provide a lift system for a blind or shade in which raising or lowering the shade will eventually eliminate bird-nesting.

These and other aspects of the invention are achieved by providing a lift system for a blind or shade having a fixed cradle, a drive shaft, and a movable shaft or shuttle defining a generally cylindrical lift cord wrapping portion, a generally cylindrical end portion and a transition member. The lift cord is connected to said movable shaft such that the transition member acts as a ramp between the end portion and the lift cord wrapping portion of the movable shaft. The shape of the transition member enables such sections of the lift cord which may wrap around the drive shaft during bird nesting to migrate back to the lift cord wrapping portion of the movable shaft, where raising and lowering of the shade enables the lift cord to resume its single layer configuration on the lift cord wrapping portion.

These and other aspects of the invention, together with features and advantages thereof, will become apparent from the following detailed description of a preferred embodiment, when taken in conjunction with the accompanying drawings.

DETAILED DESCRIPTION OF THE INVENTION

Figure 1:
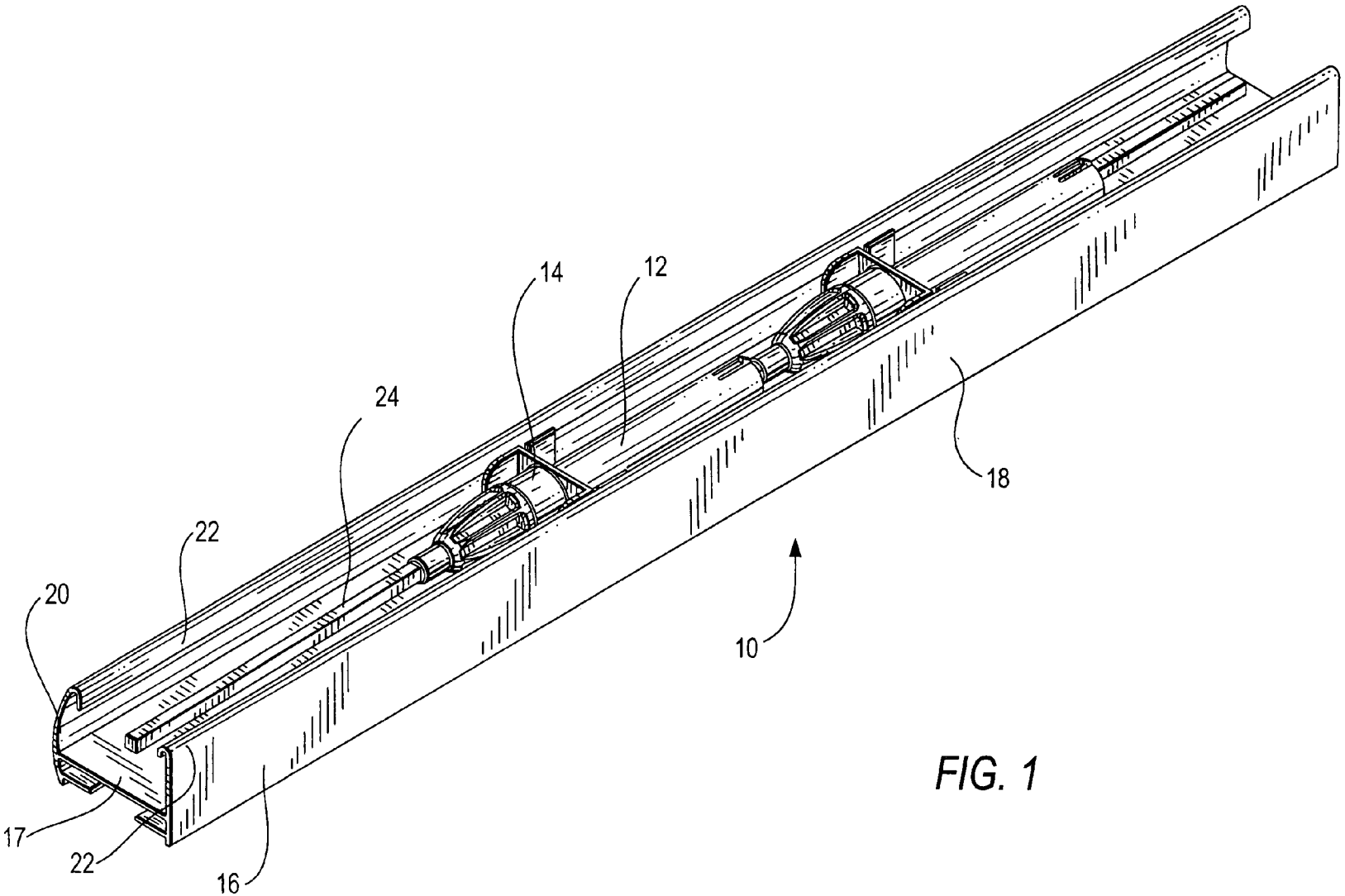
FIG. 1 is a perspective view that shows a lift system made according to an embodiment of the present invention.

FIG. 1 shows elements of a window covering lifting system 10 (for ease of description, the actual window covering, end cord, clutch and bottom rail, all known in the prior art, are not shown). More particularly, lifting system 10 includes one or more movable shafts or shuttles 12. Each movable shaft is supported by a cradle 14 which, in turn, is fixedly disposed within head rail 16. Head rail 16 includes bottom wall 17 and upstanding side walls 18 and 20 extending from bottom wall 17. Each upstanding wall 18, 20 terminates in longitudinally extending lips 22 which form grooves for receiving cradle 14. Movable shaft 12 receives, and is longitudinally movable on, a drive shaft 24, which may be of rectangular or square cross section and is usually formed of metal.

As is known in the art, drive shaft 24 is connected to a clutch mechanism (not shown), allowing a window covering to be raised or lowered by a user. More particularly, and as is well known in the art, to raise or lower a window covering (not shown), such as a shade or blind, a user pulls on a main raising or lowering cord (also not shown), usually located at one or the other end of head rail 16. This rotates the drive shaft, thereby wrapping and unwrapping the lift cord, and enabling the window covering to be raised or lowered, as is generally understood.

Figure 2:
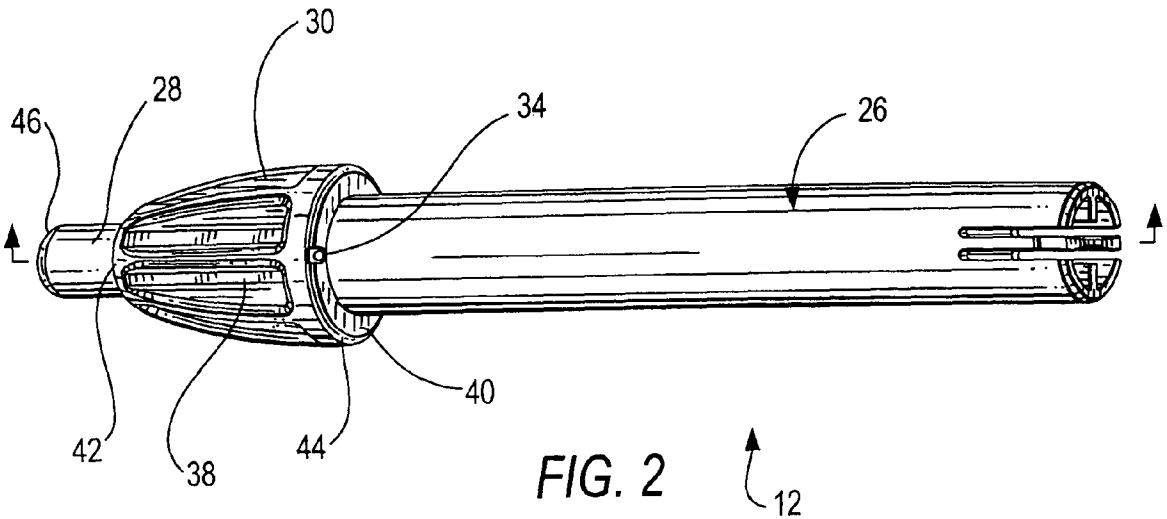
FIG. 2 is a top perspective view that shows a movable shaft or shuttle according to the present invention.

FIG. 2 shows movable shaft or shuttle 12 in more detail. Movable shaft 12 includes a generally cylindrical lift cord wrapping portion 26, a generally cylindrical end portion 28 having a thickness smaller than the outside diameter of lift cord wrapping portion 26, and a transition member 30 disposed between lift cord wrapping portion 26 and end portion 28. Lift cord 32 (see FIG. 5) is connected to movable shaft 12, for example to transition member 30, preferably at a location on the transition member near cord wrapping portion 26. Lift cord 32 is advantageously connected to transition member 30 by inserting one end of lift cord 32 through a hole 34 in transition member 30 and then knotting the lift cord end, although other ways of connecting the end of lift cord 32 to transition member 30 are possible.

Lift cord 32 is usually maintained in tension, and thus tends to wrap around lift cord wrapping portion 26 of movable shaft 12. This tension is the result of the weight of the bottom rail (not shown) and the weight of the blind or shade (not shown) to which lift cord 32 is attached.

Transition member 30, which may be formed with a plurality of ribs 38 to save on material and for ease of fabrication, has a first end 40 and an opposite or second end 42. End 40, defining a generally upstanding wall 41 (see FIG. 4), is advantageously rounded at annular edge 44. Similarly, second end 42 is also rounded. Rounding of the ends is desirable, because transition member 30 acts as a ramp to allow lift cord 32 to migrate back to lift cord wrapping portion 26 once bird nesting occurs, as will be hereinafter explained, and sharp edges or corners, especially at end 42, might well provide an impediment to such migration. Similarly, rounding of wall 41 at annular edge 44 facilitates lift cord 32 falling off transition member 30 as the lift cord migrates to lift cord wrapping portion 26.

Similarly, end portion 28 of movable shaft 12 is rounded at 46, in order to also eliminate any sharp edge which would prevent or otherwise impede migration of lift cord 32 back to lift cord wrapping portion 26 to the extent that lift cord 32, during bird nesting, wraps around drive shaft 24.

Figure 5:
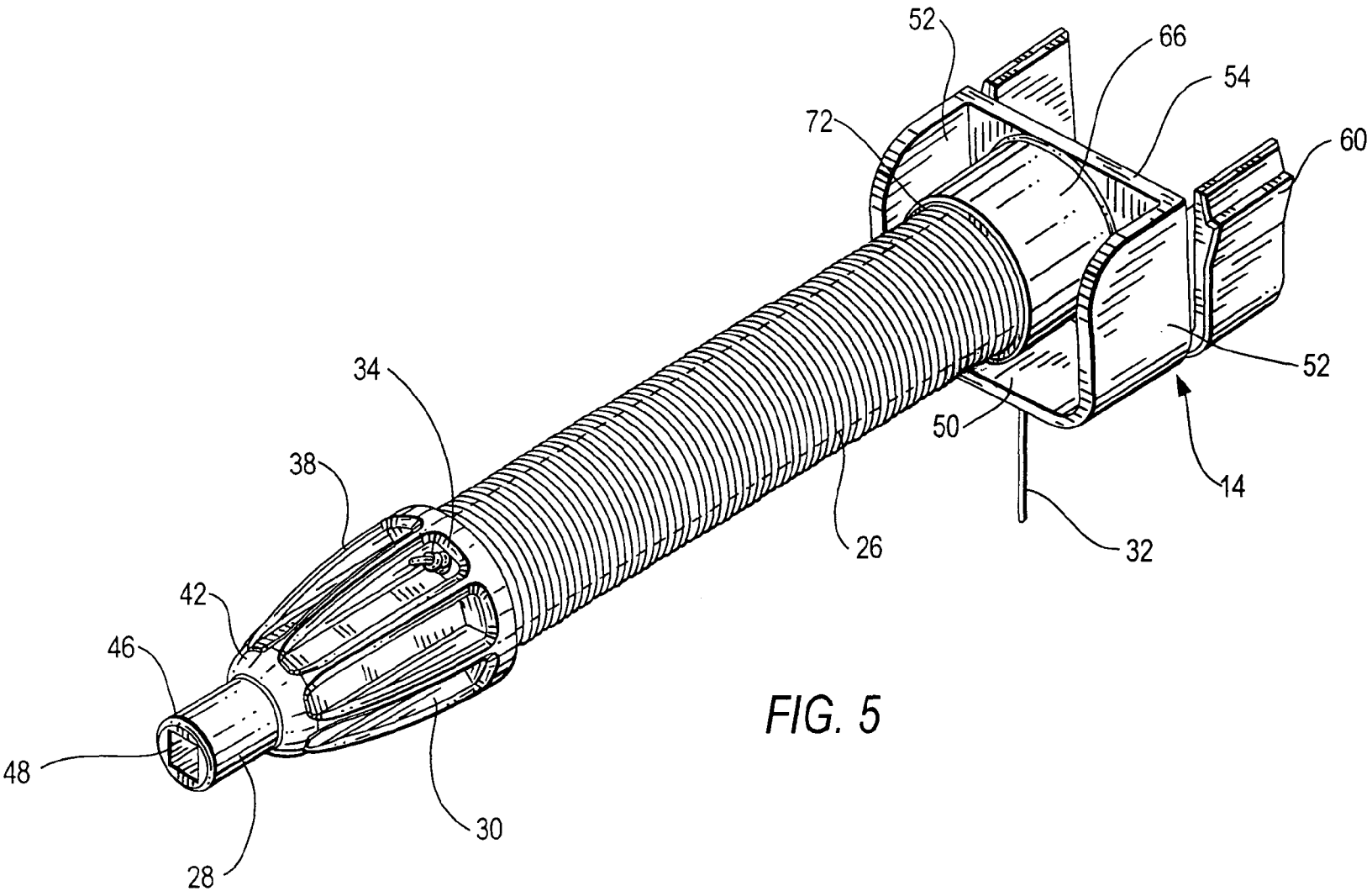
FIG. 5 is a perspective view that shows the cradle and movable shaft of the present invention, with a lift cord wound around the lift cord wrapping portion of the movable shaft, as would occur with the window covering in a substantially fully raised position.

As shown in FIG. 5, movable shaft 12 is formed with a square bore 48 running through movable shaft 12. Bore 48 receives metal drive shaft 24 (see FIG. 8), thus supporting movable shaft 12. Bore 48 is sized to allow movable shaft 12 to move longitudinally along the axis of drive shaft 24 as drive shaft 24 is rotated. It also allows movable shaft 12 to rotate along with drive shaft 24. Movable shaft 12 is also supported by cradle 14, which receives lift cord wrapping portion 26 of movable shaft 12.

Figure 3:
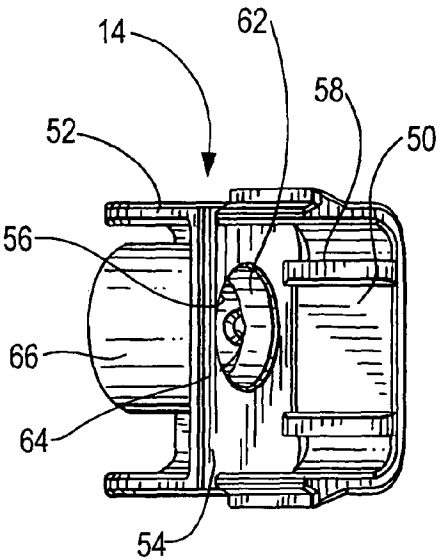
FIG. 3 is a top perspective view that shows a cradle according to the present invention.
Figure 3A:
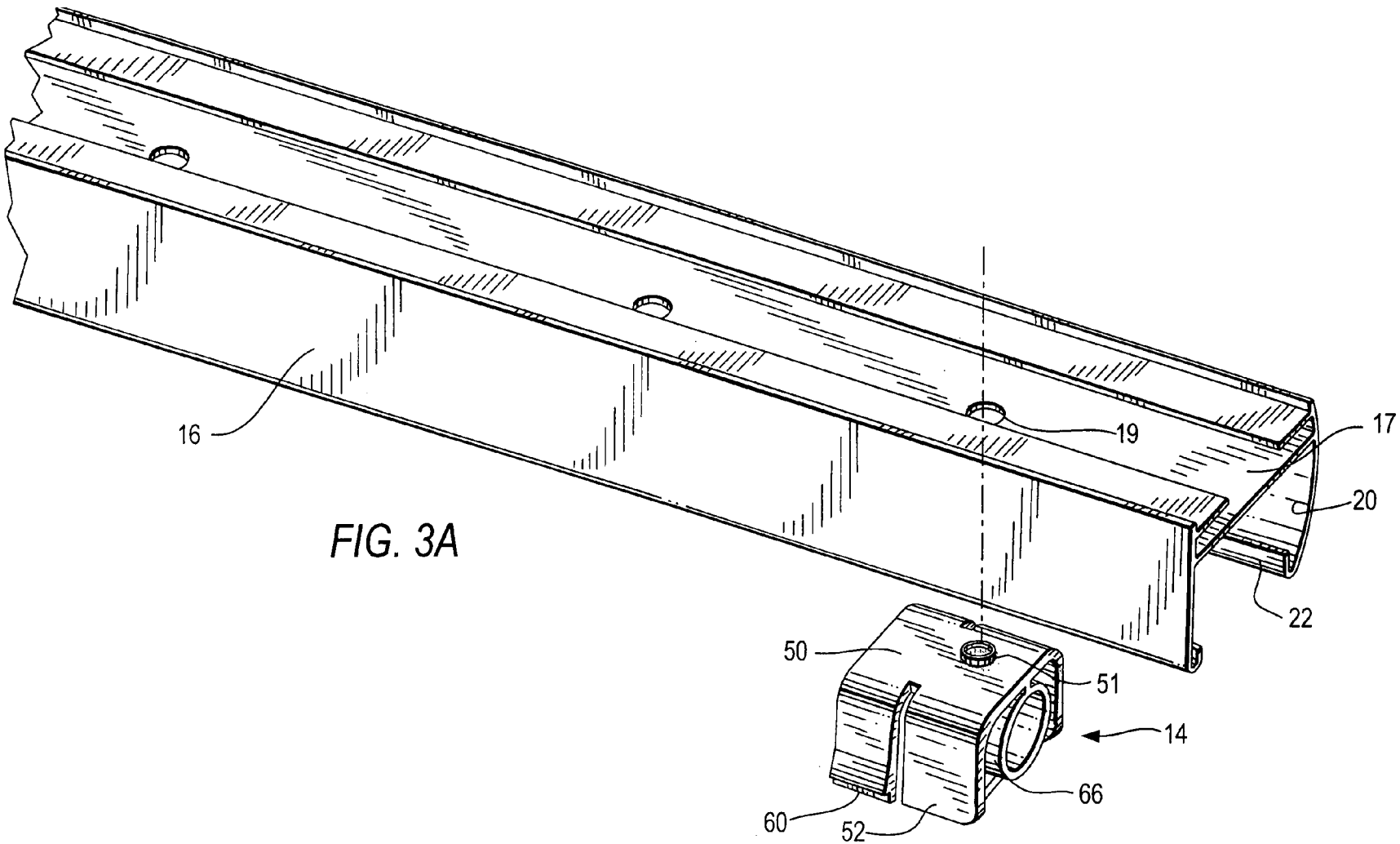
FIG. 3A is a bottom, exploded perspective view showing how the cradle fits within a head rail according to the present invention.
Figure 4:
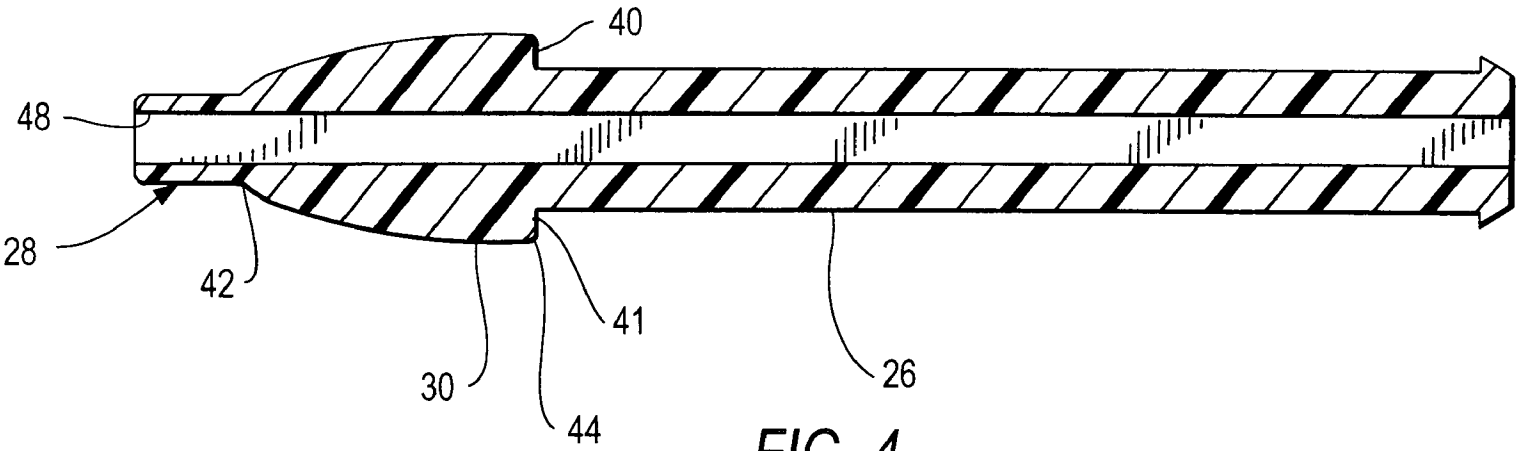
FIG. 4 is a sectional view of the movable shaft or shuttle, taken along the line X-X of FIG. 2.

As shown in FIGS. 3, 3A and 4, cradle 14 has a bottom wall 50, two side walls 52 extending upwardly from bottom wall 50, and an upstanding wall 54 extending between the two side walls to provide added rigidity to cradle 14. Wall 54 also supports movable shaft 12 at lift cord wrapping portion 26, which is inserted through a circular opening 56 in the wall. Circular opening 56 is sized to allow the movable shaft to rotate and also to move axially relative to cradle 14. Further rigidity for cradle 14 is provided by short upstanding ribs 58 which extend upwardly from bottom wall 50 (see FIG. 3). Wall 52 further defines a flange 60 which provides a "snap fit" with lip 22 of head rail 16 (see FIG. 1), locating cradle 14 within head rail 16.

As shown in FIG. 3A, cradle 14 is also formed with a cradle boss 51 which fits into a mating hole 19 formed in bottom wall 17 of head rail 16, thus locking cradle 14 into position within head rail 16. Referring to both FIG. 3 and FIG. 3A, lift cord 32 extends through mating hole 19 in head rail 16 into cradle 14 through an aperture 64 defined in bottom wall 50 and cradle boss 51.

A camming surface 62, also shown in FIG. 3, extends outwardly from wall 54 at circular opening 56. Camming surface 62 acts to drive lift cord 32 onto lift cord wrapping portion 26 of movable shaft 12, as is generally known in the art. Aperture 64 is formed in a relatively short cylindrical guide 66 terminating at end wall 72 (see FIG. 5). The inner dimension of cylindrical guide 66 is such that the distance between lift cord wrapping portion 26 and the inside of the cylindrical guide is slightly greater than the diameter of lift cord 32. Thus, as lift cord 32 is pushed off camming surface 62, the lift cord wraps around lift cord wrapping portion 26 of movable shaft 12 in a single layer. Moreover, as lift cord 32 is pushed off camming surface 62, the lift cord causes movable shaft 12 to move axially in a direction away from cradle 14.

Figure 6:
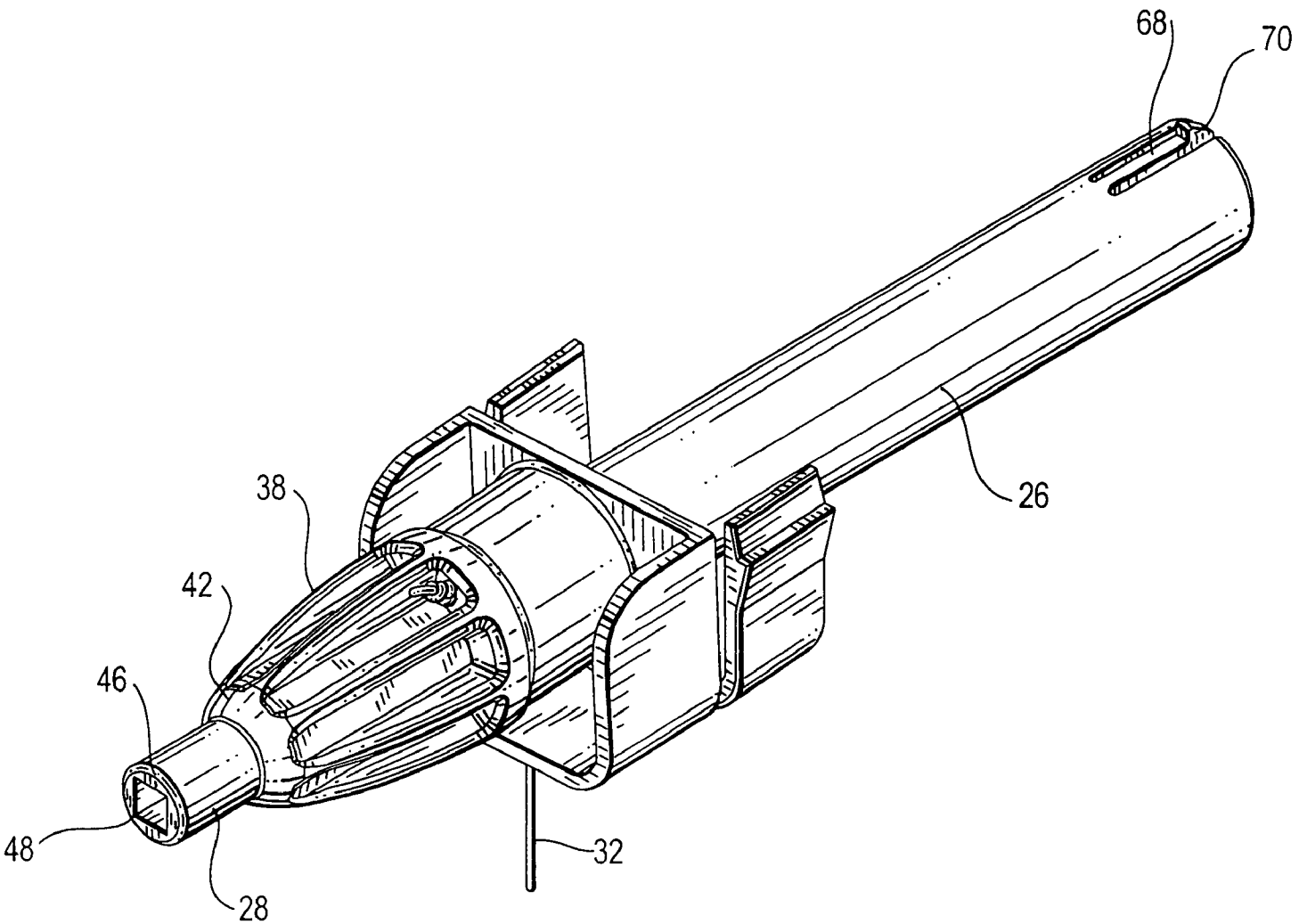
FIG. 6 is a perspective view similar to that of FIG. 5, but showing the lift cord unwound from the lift cord wrapping portion of the movable shaft, as would occur with the window covering in a substantially fully lowered position.
Figure 7:
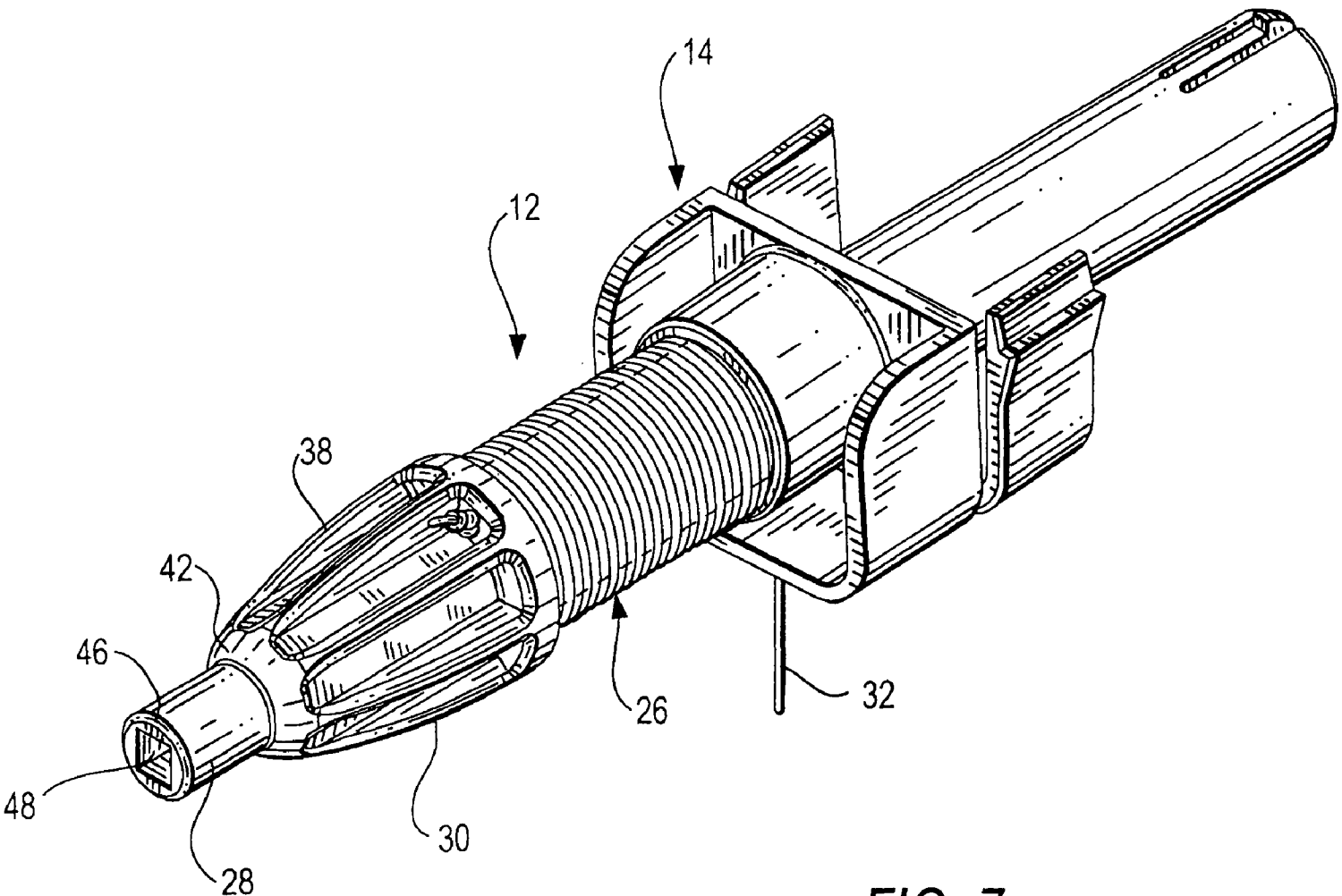
FIG. 7 is a perspective view similar to that of FIG. 5, but showing the lift cord partially wrapped around the lift cord wrapping portion of the movable shaft, as would occur with the window covering in a mid-position between it being substantially fully raised and substantially fully lowered.

FIGS. 5, 6 and 7 show cradle 14 and movable shaft 12 in various positions (for ease of explanation, drive shaft 24 and head rail 16 have been omitted) depending on the position of the window covering.

Thus, in FIG. 5, the window covering is in a substantially raised condition. As such, the majority of lift cord 32 has wrapped around lift cord wrapping portion 26 of the movable shaft, with the lift cord, under tension, being pushed onto the lift cord wrapping portion by the action of camming surface 62. In this condition, end 28 of rotating shaft 12 is furthermost from cradle 14. Further movement of rotating shaft 12 away from cradle 14 is prevented by a flexible finger 68, terminating in a stop 70 that is formed at the end of lift cord wrapping portion 26 (see FIG. 6). Not only does finger 68 and stop 70 prevent further movement of movable shaft 12 away from cradle 14, but inward pressure on finger 68 into the space defined by square bore 48 enables movable shaft 12 initially to be inserted into cradle 14.

More particularly, once movable shaft 12 has been inserted into cradle 14, the movable shaft and cradle are inserted into head rail 16, with cradle boss 51 aligning with and fitting into mating hole 19 in head rail 16. Drive shaft 24 is then inserted through square bore 48 defined in movable shaft 12. Once drive shaft 24 is in place, inward movement of finger 68 is now inhibited. This assures that unintentional disassembling of movable shaft 12 from cradle 14 is prevented.

FIG. 6 shows the position of movable shaft 12, cradle 14, and lift cord 32, when the window covering is in its substantially lowermost position. In this position of the window covering, the vast majority of lift cord 32 has been unwrapped from lift cord wrapping portion 26, and end wall 41 (see FIG.

4) of transition member 30 is in close proximity to, if not abutting, end wall 72 (see FIG. 5) of cylindrical guide 66 of cradle 12.

FIG. 7 shows the position of movable shaft 12, cradle 14, and lift cord 32, when the window covering is in a mid-position. In this position of the window covering, a portion of lift cord 32, under tension, is disposed on lift cord wrapping portion 26 of movable shaft 12, with the amount of lift cord on lift cord wrapping portion 26 depending on the actual position of the window covering (e.g., the higher the window covering, the more cord on the lift cord wrapping portion, and the lower the window covering, the less cord on the lift cord wrapping portion).

In all of the positions shown in FIGS. 5-7, the lift system for the window covering operates satisfactorily and efficiently. In other words, lift cord 32 is wrapped or unwrapped from lift cord wrapping portion 26 with the cord being in a single layer.

Figure 8:
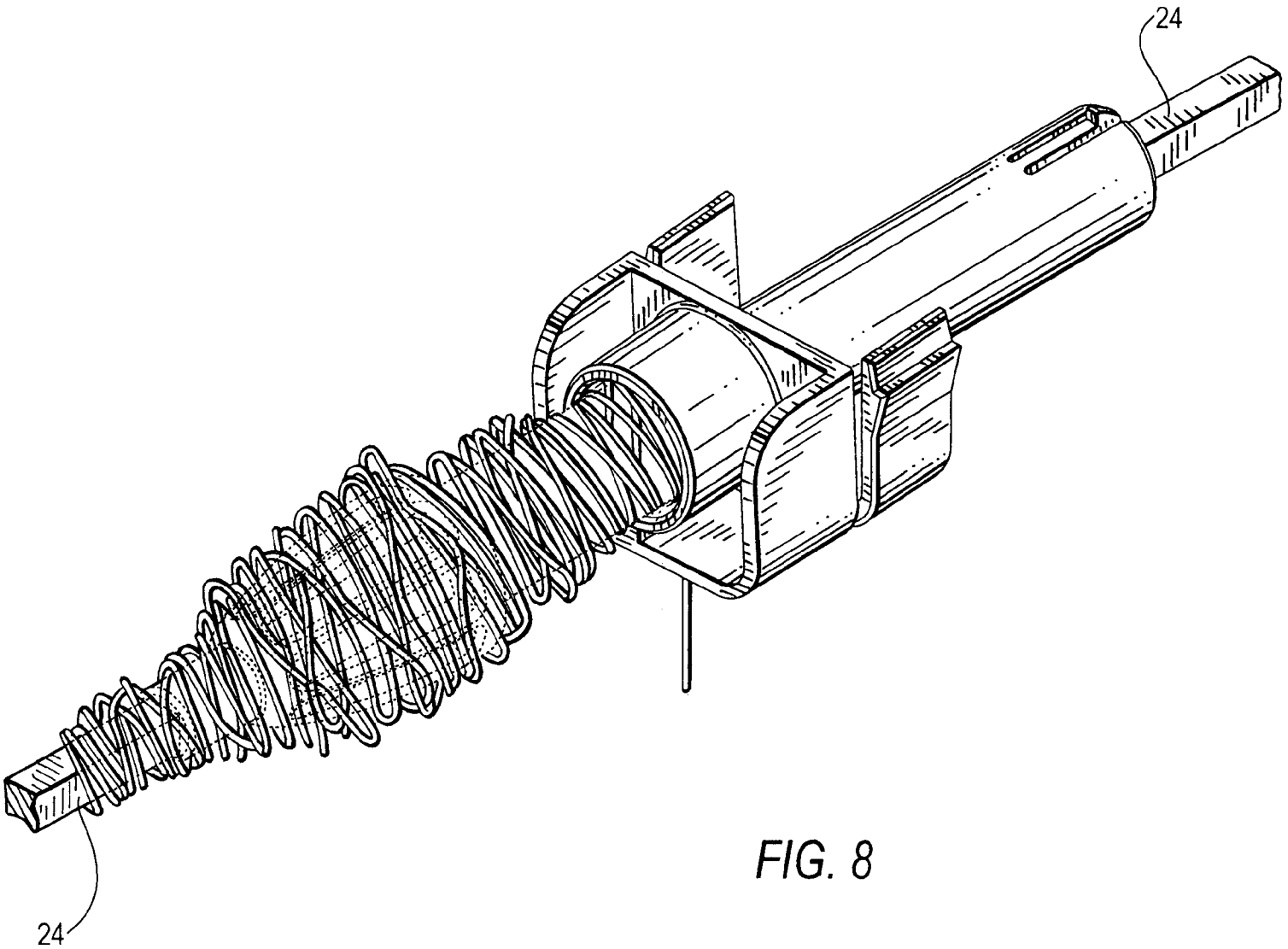
FIG. 8 is a perspective view similar to that of FIG. 7, but showing the lift cord in a "bird nesting" condition.

FIG. 8 illustrates what happens when lift cord 32 becomes tangled. This condition, called bird nesting, often occurs when an end of the blind or shade hits an obstacle as the shade is raised or lowered, or if only one end of the blind or shade is raised or lowered. When this occurs, lift cord 32 is no longer in tension, and portions of lift cord 32 loosely wrap around transition member 30, end portion 28 and drive shaft 24.

When bird nesting occurs, it is imperative that lift cord 32 eventually move back to a position where the window covering can be properly raised or lowered. That is, lift cord 32 should migrate back to lift cord wrapping portion 26 of movable shaft 12. Prior to the present invention, this migration was made difficult, especially if lift cord 32 wraps itself around drive shaft 24.

Transition member 30 facilitates this needed migration by providing a ramping action for lift cord 32. When bird nesting does occur, it is found that raising and lowering of the window covering causes lift cord 32, which is in tension, to migrate back to lift cord wrapping portion 26. More particularly, raising and lowering of the window covering (one or more cycles may be required), enables lift cord 32 to migrate from drive shaft 24, from end portion 28 of movable shaft 12, and from the narrower end 42 of transition member 30, until such time as lift cord 32 eventually is disposed along lift cord wrapping portion 26. Once lift cord 32 is disposed along lift cord wrapping portion 26, even if lift cord 32 is not initially wrapped around lift cord wrapping portion 26 in a single layer, further raising and lowering of the window covering will eventually cause lift cord 32 to wrap around lift cord wrapping portion 26 in a single layer. This is because of the spacing between cylindrical guide 66 of cradle 14 and the outside of wrapping portion 26 of movable shaft 12. In this regard, since cylindrical guide 66 is relatively short, lift cord 32 will not tend to become jammed within the spacing, as has been the case in prior art systems.

Figure 9:
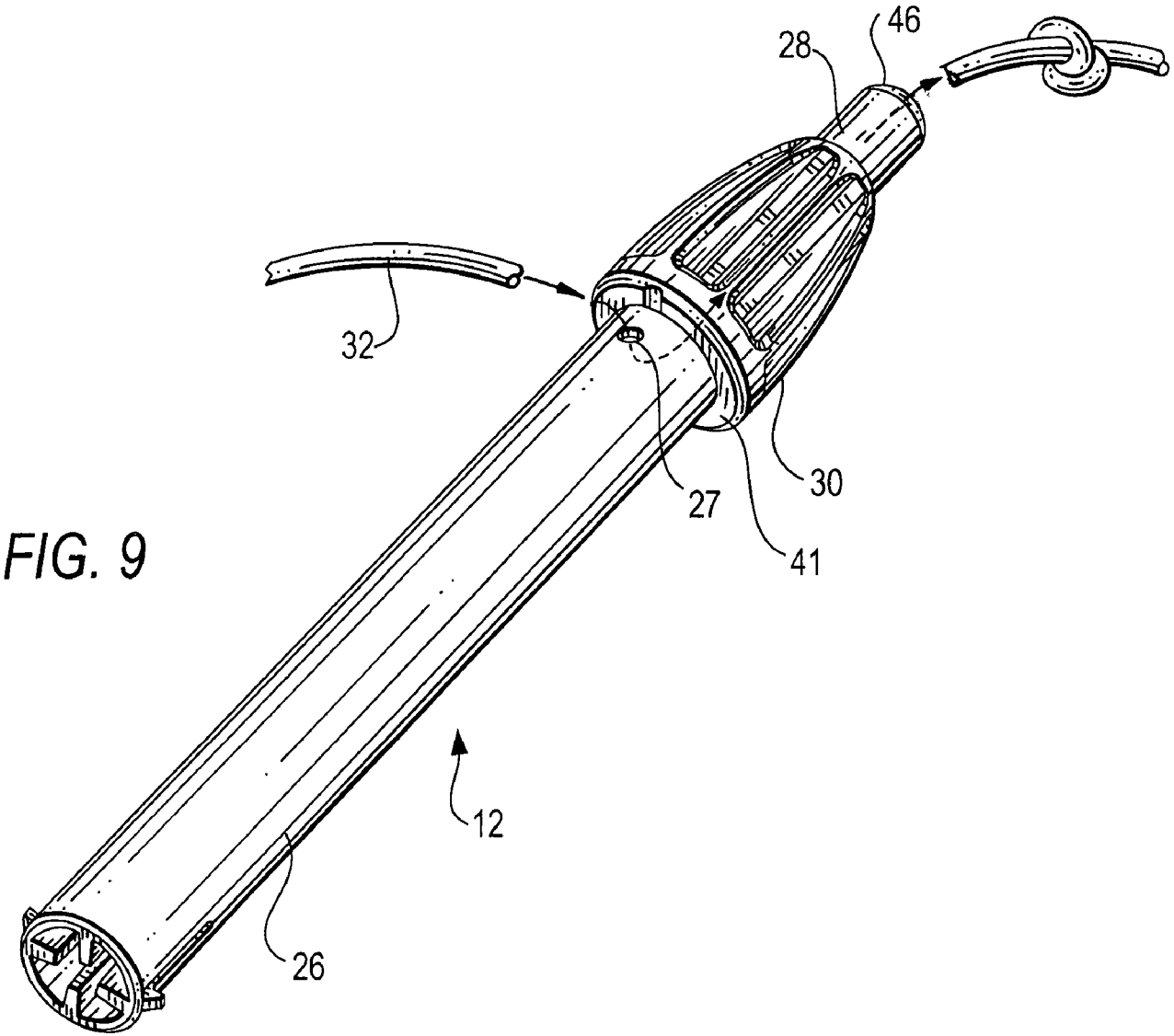
FIG. 9 is a perspective view of the movable shaft and showing an alternative way of connecting the lift cord to the movable shaft according to an alternative embodiment of the invention.

FIG. 9 shows an alternative way for connecting lift cord 32 to movable shaft 12. In this alternative embodiment, rather than connecting lift cord 32 to transition member 30, lift cord 32 is connected to lift cord wrapping portion 26 by inserting lift cord 32 into an aperture 27 located near wall 41 of transition member 30. In this regard, the end of lift cord 32 is inserted into aperture 27 thereby enabling the lift cord to pass through square bore 48 defined through the center of the movable shaft until the end of lift cord 32 exits the movable shaft at rounded end 46 of end portion 28. The end of lift cord 32 is then knotted and pulled back into the interior of movable shaft 12, where it normally rests against the interior portion of aperture 27.

The dimensions of movable shaft 12 are, to some degree, dependent on the diameter of lift cord 32 and the length of the shade or blind or other window covering. For example, the length of lift cord wrapping portion 26 should be sufficient to enable lift cord 32 to fully wrap onto cord wrapping portion 26 when the window covering is fully raised. As another example, the thickness of end portion 28 of movable shaft 24 should preferably be less than the diameter of lift cord 32, so as to facilitate the migration of lift cord 32 from drive shaft 24, to end portion 28 and then to transition member 30 once bird nesting has occurred. Similarly, because sharp edges on movable shaft 12 might also impede proper migration of lift cord 32, end 42 of transition member 30 is preferably rounded. Alternatively, any shoulder at end 42 should be of a dimension approximately equal to or less than the diameter of lift cord 32.

Thus, the present invention provides a lifting system for a window covering which recognizes that bird nesting often occurs, but nonetheless allows the lift cord to migrate back to a position where raising and lowering of the window covering eventually enables the lift cord to resume its "normal" condition prior to bird nesting. This is accomplished by transition member 30 which, due to its ramping action, facilitates the migration of lift cord 32 back to lift cord wrapping portion 26.

Figure 10:
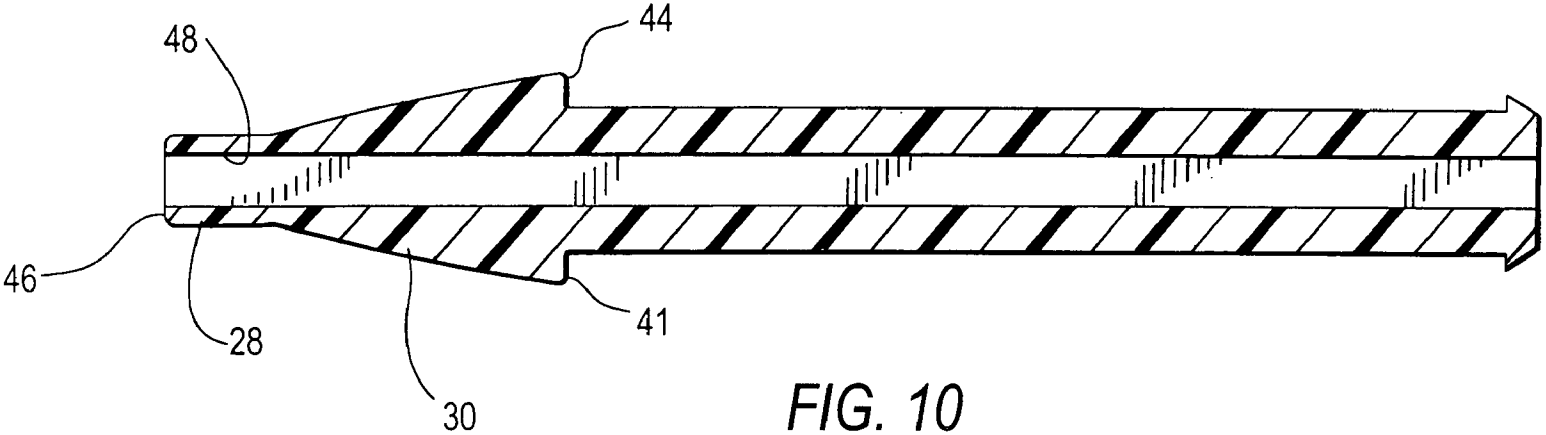
FIG. 10 is a cross-sectional view, similar to that of FIG. 4, but showing a movable shaft according to a second embodiment of the invention.

While the present invention has been described with reference to a preferred embodiment, the invention should not be so limited. For example, while transition member 30 has been shown as generally parabolic in shape (e.g., convex in cross-section), it is understood that it may be formed of one or more conical sections. Such an alternative embodiment is shown in FIG. 10. In this embodiment, transition member 30 is substantially similar to the parabolically shaped cross section previously discussed. For example, lift cord 32 is connected to movable shaft 12 at either the transition member or at the lift cord wrapping portion and the transition member provides the ramping action in order to facilitate migration of lift cord 32 to lift cord wrapping portion 26 of the movable shaft after bird nesting has occurred. However, in this embodiment, transition member 30 is conical in cross-section, having an upstanding end wall 41 and a rounded annular edge 44 (as in the embodiment shown in FIG. 4). Transition member 30 may also be concave in cross-section or of an undulated cross-section, as long as these cross-sections provides the desired "ramping" action to facilitate migration of the lift cord back to its desired position on lift cord wrapping portion 26.

Moreover, it has been found beneficial to "round" the respective ends of transition member 30 at first end 40 and at second end 42, especially where the transition member is parabolic in cross-section. However, the transition member also may be formed with a short chamfer or beveled edge. Similarly, if the transition member is conical, there is no need to round the end of the transition member adjacent end portion 28. The only requirement is that there be no abutments which would inhibit migration of lift cord 32 back to its normal position after bird nesting has occurred.

Still further, while movable shaft 12 has been shown as formed of a single piece defining a cord wrapping portion 26, a transition member 30 and an end portion 28, these components may be formed as separate pieces or as a combination of a single piece and one or more separate components.

The scope of the invention will now be set forth in the following claims:

1. A lifting system for a window covering comprising:

a cradle;

a drive shaft;

a movable shaft disposed on said drive shaft and supported by said cradle, said movable shaft axially movable with respect to said drive shaft and movable axially and rotatably with respect to said cradle;

said movable shaft defining a lift cord wrapping portion, an end portion, and a transition member extending between said lift cord wrapping portion and said end portion;

a lift cord connected to said movable shaft such that raising of said window covering causes said lift cord to at least partially wrap around said lift cord wrapping portion of said movable shaft and lowering of said window covering causes said lift cord to at least partially unwrap from said lift cord wrapping portion of said movable shaft;

wherein said lift cord is connected to said movable shaft to enable said transition member to facilitate migration of said lift cord from said drive shaft back to said lift cord wrapping portion of said movable shaft in order to untangle said lift cord after bird nesting as said window covering is raised or lowered.

2. A lifting system for a window covering according to claim 1, wherein said transition member is shaped to provide a ramp for said lift cord.

3. A lifting system for a window covering according to claim 1, wherein: said lift cord is connected to said lift cord wrapping portion.

4. A lifting system for a window covering according to claim 1, wherein: said lift cord is connected to said transition member.

5. A lifting system for a window covering according to claim 1, wherein:

said lift cord wrapping portion of said movable shaft is cylindrical in shape.

6. A lifting system for a window covering according to claim 1, wherein:

said cradle supports said movable shaft at said lift cord wrapping portion.

7. A lifting system for a window covering according to claim 1, wherein:

said transition member of said movable shaft is conical in shape.

8. A lifting system for a window covering according to claim 1, wherein:

said end portion of said movable shaft has an end disposed away from said transition member that is rounded in order to facilitate the lift cord moving from said drive shaft to said end portion of said movable shaft after bird nesting.

9. A lifting system for a window covering according to claim 1, wherein:

said transition member of said movable shaft is parabolic in shape.

10. A lifting system for a window covering according to claim 1, wherein:

said lift cord has a diameter and said end portion of said movable shaft has a thickness less than said diameter of said lift cord.

11. A lifting system for a window covering according to claim 1, wherein: said transition member of said movable shaft has a first end and a second end.

12. A lifting system for a window covering according to claim 11, wherein: said lift cord is connected to said transition member near said first end of said transition member.

13. A lifting system for a window covering according to claim 11, wherein: said lift cord is connected to said lift cord wrapping portion near said first end of said transition member.

14. A lifting system for a window covering according to claim 11, wherein: said first end of said transition member is larger in size than said second end of said transition member.

15. A lifting system according to claim 11, wherein:

said second end of said transition member is rounded to facilitate said lift cord moving from said end portion of said movable shaft to said transition member after bird nesting.

16. A lifting system for a window covering comprising:

a cradle;

a drive shaft;

a movable shaft disposed on said drive shaft and supported by said cradle, said movable shaft axially movable with respect to said drive shaft and movable axially and rotatably with respect to said cradle;

said movable shaft defining a cylindrical lift cord wrapping portion, a cylindrical end portion, and a transition member having a first end adjacent said cylindrical lift cord wrapping portion and having a smaller second end adjacent said cylindrical end portion;

a lift cord connected to said movable shaft such that raising of said window covering causes said lift cord to at least partially wrap around said lift cord wrapping portion of said movable shaft and lowering of said window covering causes said lift cord to at least partially unwrap from said lift cord wrapping portion of said movable shaft;

wherein said lift cord is connected to said movable shaft to enable said transition member to facilitate migration of said lift cord from said drive shaft back to said cylindrical lift cord wrapping portion of said movable shaft in order to untangle said lift cord after bird nesting as said window covering is raised or lowered.

17. A lifting system for a window covering according to claim 16, wherein:

said lift cord is connected to said cylindrical lift cord wrapping portion.

18. A lifting system according to claim 17, wherein:

said lift cord is connected to said cylindrical lift cord wrapping portion adjacent said first end of said transition member.

19. A lifting system for a window covering according to claim 16, wherein:

said lift cord is connected to said transition member.

20. A lifting system for a window covering according to claim 19, wherein:

said lift cord is connected to said transition member near said first end of said transition member.

21. A lifting system for a window covering according to claim 16, wherein:

said lift cord has a diameter and said cylindrical end portion of said movable shaft has a thickness less than the diameter of said lift cord.

22. A lifting system for a window covering according to claim 16, wherein:

said cylindrical end portion of said movable shaft has an end disposed away from said transition member that is rounded in order to facilitate said lift cord moving from said drive shaft to said cylindrical end portion of said movable shaft after bird nesting.

23. A lifting system for a window covering according to claim 16, wherein:

said transition member is conical in shape.

24. A lifting system for a window covering according to claim 23, wherein:

said first end of said transition member has a rounded annular section in order to facilitate migration of said lift cord from said transition member to said cylindrical lift cord wrapping portion of said movable shaft.

25. A lifting system for a window covering according to claim 16, wherein:

said transition member is parabolic in shape.

26. A lifting system for a window covering according to claim 25, wherein:

said second end of said transition member is rounded to facilitate said lift cord moving from said end portion of said movable shaft to said transition member after bird nesting.

27. A lifting system for a window covering according to claim 26, wherein:

said first end of said transition member has a rounded annular section in order to facilitate migration of said lift cord from said transition member to said cylindrical lift cord wrapping portion of said movable shaft.

* * * * *